US012747580B2

(12) United States Patent
Baverel et al.

(10) Patent No.: US 12,747,580 B2
(45) Date of Patent: Sep. 29, 2026

(54) FASTENER FOR ARRANGING A FRAMEWORK WITH PROFILED ELEMENTS CURVED ALONG PSEUDO-GEODESIC CURVES

(71) Applicant: ECOLE NATIONALE DES PONTS ET CHAUSSEES, Champs-sur-Marne (FR)

(72) Inventors: Olivier Baverel, Saint Martin le Vinoux (FR); Romain Mesnil, Vincennes (FR)

(73) Assignee: ÉCOLE NATIONALE DES PONTS ET CHAUSSÉES, Champs-sur-Marne (FR)

( * ) Notice: Subject to any disclaimer, the term of this patent is extended or adjusted under 35 U.S.C. 154(b) by 286 days.

(21) Appl. No.: 18/550,144

(22) PCT Filed: Mar. 14, 2022

(86) PCT No.: PCT/FR2022/050455
§ 371 (c)(1),
(2) Date: Sep. 12, 2023

(87) PCT Pub. No.: WO2022/195209
PCT Pub. Date: Sep. 22, 2022

(65) Prior Publication Data

US 2024/0218654 A1 Jul. 4, 2024

(30) Foreign Application Priority Data

Mar. 17, 2021 (FR) ..... 2102666

(51) Int. Cl.
*E04B 1/38* (2006.01)
*E04B 1/32* (2006.01)

(52) U.S. Cl.
CPC ..... *E04B 1/388* (2023.08); *E04B 1/3211* (2013.01); *E04B 2001/3241* (2013.01); *E04B 2001/389* (2023.08)

(58) Field of Classification Search
CPC ..... E04B 1/388; E04B 1/5831; E04B 1/2403; E04B 1/3211; E04B 2001/389;
(Continued)

(56) References Cited

U.S. PATENT DOCUMENTS 2,545,556 A * 3/1951 Pont ..... E04B 7/14 D25/56
4,009,543 A * 3/1977 Smrt ..... E04B 1/3211 52/81.3

(Continued)

FOREIGN PATENT DOCUMENTS

DE 410276 A * 8/1992 ..... E04B 1/19
DE 4101276 8/1992

(Continued)

OTHER PUBLICATIONS

International Search Report for application No. PCT/FR2022/050455 dated Jul. 6, 2022.

*Primary Examiner* — Brian E Glessner
*Assistant Examiner* — Adam G Barlow
(74) *Attorney, Agent, or Firm* — Perman & Green, LLP

(57) ABSTRACT

A fastener for securing two profiled elements together, including two half-fasteners linked together by a link of the fixed pivot type allowing one half-fastener to pivot with respect to the other about a pivot axis, each half-fastener having a fixing member for fixing a profiled element which is inclined with respect to the pivot axis. This fastener makes it possible to form a gridshell by securing pseudo-geodesic longitudinal profiled elements to pseudo-geodesic transverse profiled elements.

6 Claims, 3 Drawing Sheets

(58) Field of Classification Search
CPC ..... E04B 1/1903; E04B 2001/2415; E04B 2001/2433; E04B 2001/2439; E04B 2001/2451; E04B 2001/2457; E04B 2001/5868; E04B 2001/2616; E04B 2001/2644; F16B 5/0084; F16B 5/121; Y10T 403/32254; Y10T 403/32262; Y10T 403/32319
USPC ..... 52/801, 80.2, 81.1, 81.2, 81.3, 708
See application file for complete search history.

(56) References Cited

U.S. PATENT DOCUMENTS 4,182,086 A * 1/1980 Crooks ..... E04B 1/3211 52/309.4
4,904,108 A * 2/1990 Wendel ..... E04B 1/1912 403/356
4,998,552 A * 3/1991 Niksic ..... E04B 1/3441 52/81.3
5,181,355 A * 1/1993 Skolnick ..... E04B 1/3211 52/81.3
5,430,989 A * 7/1995 Jones ..... E04B 1/1903 52/81.3
6,276,095 B1 * 8/2001 Tripsianes ..... E04B 1/3211 52/80.1
8,528,291 B2 * 9/2013 Allred, III ..... E04C 3/08 52/81.3
8,590,216 B1 * 11/2013 Hurt, III ..... E04B 1/3211 52/81.3
2003/0226319 A1 * 12/2003 Richards ..... E04B 1/3211 52/80.1
2007/0125033 A1 * 6/2007 Stephan ..... E04B 1/32 52/81.3
2012/0180405 A1 * 7/2012 Drake ..... E04B 1/3211 249/168
2013/0255184 A1 * 10/2013 Mason ..... E04B 1/18 52/831
2021/0153440 A1 5/2021 Baverel et al.
2021/0270032 A1 * 9/2021 Janez ..... E04B 1/388
2021/0388605 A1 * 12/2021 Dutchak ..... E04B 1/3211
2025/0198146 A1 * 6/2025 Ekblaw ..... E04B 1/3211

FOREIGN PATENT DOCUMENTS

FR 3080390 10/2019
WO 2008137379 11/2008

* cited by examiner

FASTENER FOR ARRANGING A FRAMEWORK WITH PROFILED ELEMENTS CURVED ALONG PSEUDO-GEODESIC CURVES

CROSS REFERENCE TO RELATED APPLICATIONS

This application is a National Stage of International Application No. PCT/FR2022/050455 having an International Filing Date of 14 Mar. 2022, which designated the United States of America, and which International Application was published under PCT Article 21(2) as WO Publication No. 2022/195209 which claims priority from and the benefit of French Patent Application No. 2102666, filed on 17 Mar. 2021, the disclosures of which are incorporated herein by reference in their entireties.

BACKGROUND

Field

The disclosure relates to a framework comprising flexed profiled elements that intersect each other to conjointly delimit a curved surface, while being secured each another by fasteners.

Brief Description of Related Developments

In such an arrangement, also referred to as "gridshell", the profiled members are deformed in their elastic domain to follow curved shapes, and they are secured to each other at their intersections so as to conjointly constitute a rigid structure delimiting the shape of a curved surface such as a dome shape.

In this type of arrangement, the fasteners that secure the elastically flexed profiled members to each other confer the required mechanical rigidity on the assembly, this structure having, once in place, a potential energy corresponding to the elastic deformation of the profiled elements that make it up.

As shown on FIG. 1, when seen in a cross-sectional plane, a profiled element includes an axis I1 with the largest quadratic moment, and another axis I2 perpendicular to I1 having a quadratic moment smaller than or equal to its quadratic moment with respect to the axis I1.

The axis with the largest quadratic moment I1 corresponds to the one around which the profiled element has the greatest flexural rigidity. In the case of a rectangular profiled element, the axis I1 extends parallel to the narrowest flanks of the profiled element, and the axis I2, which corresponds to the one for which the profiled element has the lowest rigidity, extends parallel to the widest flanks.

To increase the mechanical rigidity of such gridshells, it is possible to use profiled elements with a non-round cross section such as profiled elements with a rectangular cross-section, fabricated from steel, composite material or other.

One possibility consists in arranging the profiled elements so that they follow so-called geodesic curves of the surface to be delimited, a curve being geodesic if, at each of the points thereof, the normal to the surface coincides with the normal to the curve when it is defined.

In practice, the profiled elements of a gridshell with geodesic lines are flexurally curved around the axis with the smallest quadratic moment of their cross section. In the case of a geodesic gridshell formed by profiled elements with a rectangular cross-section, each profiled element is thus arranged so that its flanks extend parallel to the surface, its narrowest flanks extending perpendicularly thereto.

The high flexibility of the profiled elements about their axis with the smallest quadratic moment thus makes it possible to delimit a surface in a dome shape, using the first longitudinal profiled elements and second transverse profiled elements forming conjointly a regular grid in a dome shape.

However, in a geodesic gridshell, the mechanical rigidity is dependent on the smallest quadratic moment of the cross-section of the profiled elements used, which is detrimental for the sizing of these profiled elements and therefore of the structure. Because of this, it may be necessary to stack a plurality of longitudinal or transverse profiled elements to obtain the required mechanical rigidity.

Another possibility consists in arranging the profiled elements so that they follow so-called asymptotic curves of the surface to be delimited, a curve being asymptotic if, at each point thereof, the curvature of the surface, in a plane containing the tangent to the curve and the normal to the surface, is zero.

In the case of an asymptotic gridshell formed by rectangular profiled elements, each profiled element is thus arranged so that its widest flanks extend perpendicularly to the surface, its narrowest flanks for their part extending parallel to this surface.

Thus, in the case of an asymptotic gridshell, the mechanical rigidity is dependent on the highest moment of inertia of the cross-section of the profiled elements used, which is advantageous in terms of the sizing of the profiled elements and therefore of the structure.

Nevertheless, the choice of asymptotic curves limits the variety of surfaces that can be delimited by an asymptotic gridshell: they are limited to surfaces with negative Gaussian curvature, which does not make it possible, for example, to mesh a curved surface such as a spherical surface or a dome-shaped surface.

The aim of the disclosure is to provide a solution for forming a gridshell that can delimit a large variety of surfaces and leading to an advantageous sizing of the profiled elements used.

SUMMARY

For this purpose, the object of the disclosure is a fastener for securing two profiled elements to each other, comprising two half-fasteners connected to each other by a connection of the fixed pivot type enabling one half-fastener to pivot with respect to the other about a pivot axis, each half-fastener including a member for securing a profile element that is inclined with respect to the pivot axis.

Such a fastener makes it possible to hold a profiled element inclined with respect to a surface that this profiled element helps to delimit, so that the profiled elements can follow curves of the pseudo-geodesic type, which makes it possible to delimit a large variety of surfaces, including in particular surfaces with positive Gaussian curvature, such as dome-shaped surfaces.

The disclosure also relates to a fastener thus defined, wherein the inclination of each securing member with respect to the pivot axis is adjustable.

The disclosure also relates to a fastener thus defined, wherein each half-fastener includes a base and a hook carrying the securing member, the hook being connected to the base by a connection of the fixed pivot type enabling it to rotate with respect to the base about a rotation axis normal to the pivot axis of the fastener, and a system for locking the inclination of the hook with respect to the pivot axis.

The disclosure also relates to a fastener thus defined, wherein the hook includes two cheeks extending on either side of the base, these two cheeks each having an edge rigidly secured to the securing member, these two cheeks being connected to the base by the pivot connection, each cheek comprising an edge in an arc of a circle centred on the pivot connection with holes regularly spaced along this edge, the locking system comprising a pin that can engage conjointly in a hole in each cheek and in a hole in the base.

The disclosure also relates to a fastener thus defined, wherein the inclination of the securing members with respect to the pivot axis is adjustable over an angular range extending from 0° to 90°.

The disclosure also relates to a fastener thus defined, wherein the securing member is in the form of jaws delimited by two planar portions spaced apart from each other by a distance corresponding to the thickness of the profiled element to be held.

The disclosure also relates to a framework delimiting a curved surface comprising first elastically flexed profiled elements and second elastically flexed profiled elements intersecting the first profiled elements, wherein the profiled elements are secured to each other by fasteners thus defined.

The disclosure also relates to a framework thus defined, wherein the profiled elements are hollow profiled elements with a rectangular cross-section.

The disclosure also relates to a framework thus defined, comprising profiled elements that are strips with constant width.

DETAILED DESCRIPTION

The basic idea of the disclosure is to establish a meshing of the left-hand surface by means of profiled elements along pseudo-geodesic curves of the surface that they delimit, these profiled elements intersecting while being secured to each other so as to conjointly constitute a rigid mesh.

A curve is pseudo-geodesic when, at every point thereon, the normal to the curve forms a non-zero constant angle with the normal to the surface. In general terms, pseudo-geodesic curves make it possible to delimit a greater variety of surfaces, these surfaces being able in particular to have a negative or positive Gaussian curvature such as for example in the case of a dome shape.

In the gridshell according to the disclosure, the profiled elements follow pseudo-geodesic curves of the surface that they delimit while being flexurally and/or torsionally deformed in their elastic domain. For this purpose, these profiled elements are secured to each other at each intersection by dedicated fasteners providing holding of each profiled element at a predetermined inclination with respect to the surface.

Figure 1:
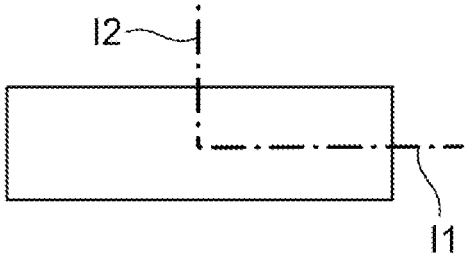
FIG. 1 (PRIOR ART)
FIG. 1 is a schematic representation of a profiled element with a rectangular cross-section.
Figure 2:
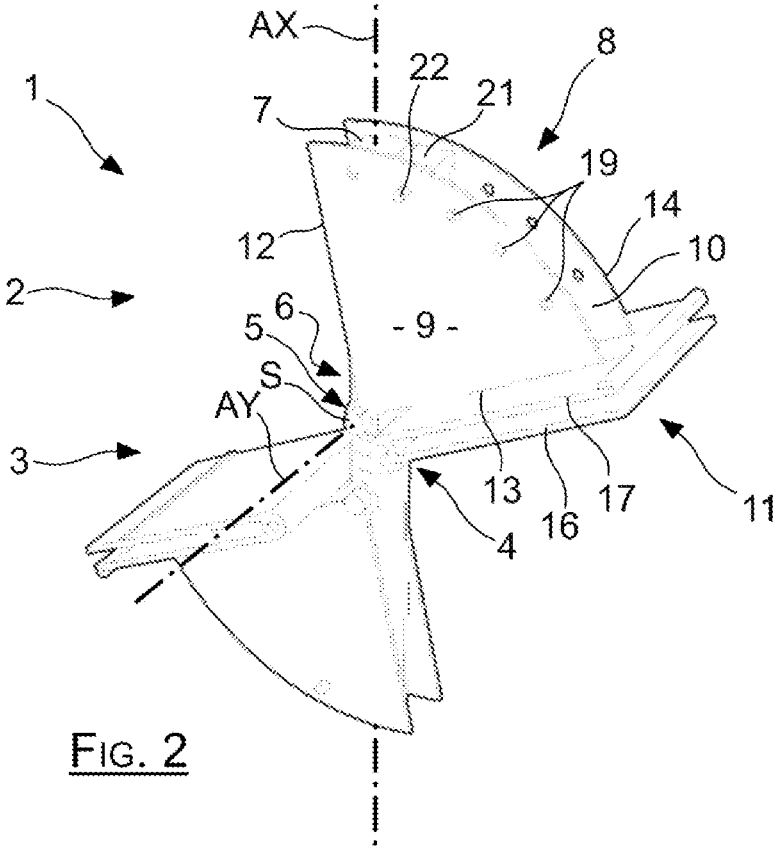
FIG. 2 is a perspective view of the fastener according to the disclosure.
Figure 3:
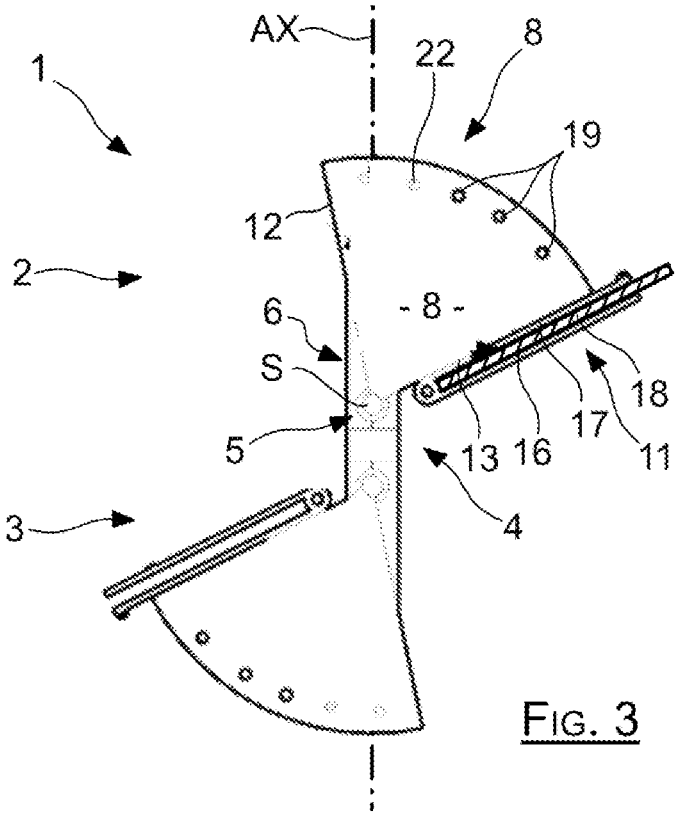
FIG. 3 is a side view of the fastener according to the disclosure.

The fasteners used are advantageously all identical and of the same type as the fastener shown on FIGS. 2 and 3, where it is referenced 1.

This fastener 1 includes two identical half-fasteners 2 and 3 that are mounted in opposite orientations while being coupled to each other by a connection of the fixed pivot type 4, of axis AX, each half-fastener being symmetrical with the other with respect to the centre of the pivot connection 4.

The half-fastener 2 includes a base 6 comprising a tubular portion 7 oriented along the axis AX, which carries a hook 8 formed by two planar cheeks 9 and 10 secured to each other by a securing member 11, the hook 8 having an orientation adjustable with respect to the base 6.

The two cheeks 9 and 10 are planar and extend parallel to each other on either side of the base 6. Each cheek 9, 10 is a planar metal plate having a contour in the form of an angular sector. This contour includes a first rectilinear edge 12 and a second rectilinear edge 13 connected at a top S, and a curved edge 14 having the form of an arc of a circle centred on the top S, this curved edge connecting the two ends of the edges 12 and 13 that are opposite to the top S. In the example in the figures, the rectilinear edges 12 and 13 form between them an angle close to a right angle.

These two cheeks are disposed at a distance from each other while being facing each other, the cheek 10 being the image of the cheek 9 by a translation in a direction normal to the plane of the cheek 10, over a distance corresponding to the diameter of the tubular portion 7.

These two cheeks are rigidly secured to each other by the fastener 11 rigidly secured at their second respective edges, and which is intended to receive a portion of a profiled element of the structure.

In the example in the figures, this fastener 11 includes essentially a plate folded in a U shape to form two planar portions 16 and 17, rectangular and parallel, which are spaced apart from each other by a distance corresponding to the thickness of the profiled element to be received, and which have a length, counted in the direction of the second edges to which they are secured, that corresponds to the width of this profiled element.

In the example in the figures, this fastener 11 receives a profiled element 18 that is of the "flat" type, i.e. formed by an initially planar strip, metal or made from a composite or other material.

As can be seen in FIGS. 2 and 3, the hook 8 is secured to the base 6 by a connection of the fixed pivot type 5, of axis AY normal to the axis AX located at the top S, which makes it possible to adjust the orientation of the hook 8 with respect to the base 6, this orientation being immobilised by a locking system.

In this regard, the cheeks 9 and 10 comprise, along their curved edges, a series of holes 19 regularly distributed along this edge, and the tubular portion of the base 6 carries, at its end furthest from the pivot connection 4, a strut 21 rigidly secured to the free end of the tubular portion 7 and which has a piercing passing through it, oriented parallel to the axis AY.

As shown on FIG. 2, the hook 8 is locked with respect to the base 6 by positioning the hook at the required angular position by turning about the axis AY, until one of the holes 19 in the cheek 10 is placed opposite the piercing passing through the strut 21 for engaging, through the hole and the piercing, a locking pin 22.

Advantageously, adjustment of inclination of the hook is possible over a range extending from 0° to 90°. When the hook is inclined at 0°, the fastener 11 extends parallel to the axis AX, i.e. perpendicularly to the surface delimited by the gridshell, which corresponds to a limit case of a profiled element along an asymptotic curve.

When the hook is inclined at 90°, the fastener 11 extends perpendicularly to the axis AX, i.e. parallel to the surface delimited by the gridshell, which corresponds to another limit case of a profiled element along a geodesic curve.

All intermediate inclinations between 0° and 90° correspond to the holding by the fastener of profiled elements along pseudo-geodesic curves along the surface that they delimit.

The inclination of the fastener 11 corresponds to the inclination of the axis with the smallest quadratic moment of the profiled element that this fastener 11 receives, with respect to the pivot axis AX of the half-fasteners that coincides with the normal to the surface delimited by the profiled elements constituting the gridshell.

In the example in FIGS. 2 and 3, the fastener 11 includes essentially two planar portions 16 and 17 that delimit a kind of jaws in a U shape in which the profiled element engages. In a complementary manner, this fastener 11 can include snap-in claws ensuring that the profiled element cannot emerge from the fastener 11 once it has been engaged therein. In a complementary manner, or alternatively, the profiled element can be secured to the fastener by gluing, riveting, by bolting or any other suitable means.

Thus, in the example in the figures, the fastener 11 is in the form of jaws intended to grip the profiled element that it receives, but this fastener may also come down to a simple plate to which a flank of the profiled element that it is intended to receive is secured.

Figure 4:
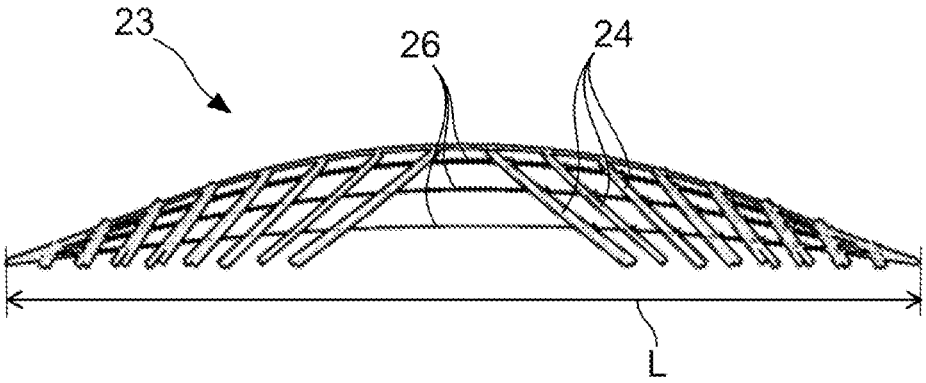
FIG. 4 is a side view of an example of a dome-shaped gridshell established in accordance with the disclosure.

In practice, establishing a gridshell according to the disclosure consists in determining the surface that is to be delimited by the profiled elements. In the example in FIGS. 4 and 5, a surface 23 in a dome shape has been selected, having, as can be seen on FIG. 4, a length L that is greater than its width 1 that appears on FIG. 5, this dome shape being similar to that of an ellipsoidal portion of revolution.

A set of pseudo-geodesic curves, comprising firstly curves extending essentially in a longitudinal direction on this surface, and secondly curves extending essentially in a transverse direction on this surface, is next determined. The longitudinal curves are selected so as to be spaced apart as regularly as possible from one another, and likewise for the transverse curves that intersect these longitudinal curves. Advantageously, the surface and the curves are defined by successive calculations made on a digital modelling of the structure.

A three-dimensional frame having the role of a template is advantageously constructed to receive the profiled elements that are to delimit the surface. Transverse profiled elements 24 are then inclined, flexed, positioned and secured on this frame in accordance with the three-dimensional longitudinal pseudo-geodesic curves previously determined. For this purpose, the frame is equipped with suitable systems for securing the profiled elements, the systems being able to be of the same type as the fasteners according to the disclosure.

At this stage, the fasteners particular to the gridshell are secured to the transverse profiled elements carried by the frame, at each point of intersection with a longitudinal pseudo-geodesic curve, these points of intersection previously having been identified and marked.

For each fastener, the inclination of one of the hooks is adjusted to the angle corresponding to the transverse profiled element to which this hook is secured, and the second hook of this fastener is adjusted to the angle of inclination of the longitudinal profiled element that it is intended to receive.

In practice, the inclination of the profiled element with respect to the surface is the same all along this profiled element, but two profiled elements can have different inclinations with respect to the surface. Each fastener including two hooks, the angular orientations of which must be adjusted, the adjustments of the hooks may be different on each fastener.

At this stage, the longitudinal profiled elements 26 can be positioned, inclined and flexed in accordance with the longitudinal pseudo-geodesic curves previously defined, and they are secured to the transverse profiled elements by the fasteners that were secured thereto in the previous step.

Once all the longitudinal profiled elements have been installed and secured, the transverse profiled elements can be disconnected from the securing systems by means of which they were secured to the three-dimensional frame. At this stage, the gridshell is formed, i.e. it can for example be handled in order to be transported from the frame to the carrier structure of a building intended to receive it.

Figure 5:
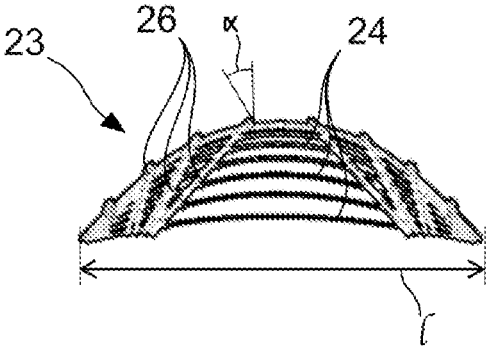
FIG. 5 is a front view of an example of a dome-shaped gridshell established in accordance with the disclosure.
Figure 6:
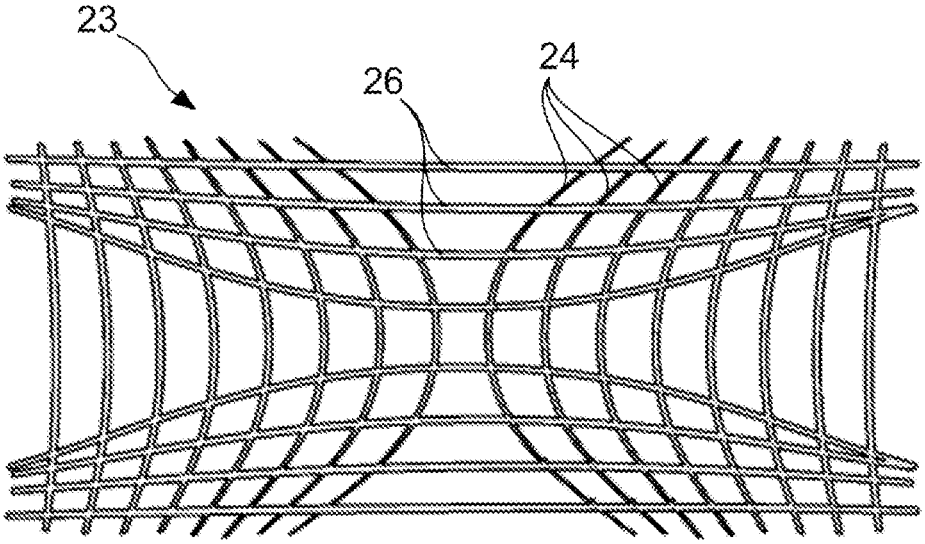
FIG. 6 is a plan view of an example of a dome-shaped gridshell established in accordance with the disclosure.

In this gridshell, each longitudinal profiled element is inclined by a certain angle with respect to the dome-shaped surface so as to follow a pseudo-geodesic curve, the inclination of one of the longitudinal profiled elements having been referenced "alpha" on FIG. 5. In a similar manner, each transverse profiled element has, with respect to the dome-shaped surface, a predetermined inclination corresponding to the adjustment of the angles of the hooks that hold it. As indicated above, once the gridshell is formed, each fastener has its pivot axis oriented perpendicularly to the surface of the gridshell.

What is claimed is:

1. A fastener for securing to each other two profiled elements that are intersecting, the fastener comprising two half-fasteners connected to each other by a connection of a fixed pivot type enabling one half-fastener to pivot with respect to the other about a pivot axis, each half-fastener including a securing member for securing a profile element, the securing member being inclined with respect to the pivot axis with an inclination that is intermediate between 0° and 90°, wherein the inclination of each securing member with respect to the pivot axis is adjustable, and wherein each half-fastener includes a base and two cheeks that carry the securing member, the two cheeks being connected to the base by a connection of the fixed pivot type enabling the two cheeks to rotate with respect to the base about a rotation axis normal to the pivot axis of the fastener, and a system for locking the inclination of the two cheeks with respect to the pivot axis.

2. The fastener according to claim 1, wherein the two cheeks extend on either side of the base, these two cheeks each having an edge rigidly secured to the securing member, these two cheeks being connected to the base by the pivot connection, each cheek comprising an edge in an arc of a circle centred on the pivot connection with holes regularly spaced along this edge, the locking system comprising a pin that can engage conjointly in a hole in each cheek and in a hole in the base.

3. The fastener according to claim 1, wherein the securing member is in the form of jaws delimited by two planar portions spaced apart and configured to hold the profiled element.

4. A framework delimiting a curved surface comprising first elastically flexed profiled elements and second elastically flexed profiled elements intersecting the first profiled elements, characterised in that the profiled elements are secured to each other by fasteners as defined in claim 1.

5. The framework according to claim 4, wherein the profiled elements are hollow profiled elements with a rectangular cross-section.

6. The framework according to claim 4, comprising profiled elements that are strips with constant width.

* * * * *